United States Patent [19]

Buan et al.

[11] Patent Number: 4,458,593

[45] Date of Patent: Jul. 10, 1984

[54] INDICIA PLATE FOR A POSTAGE METER

[75] Inventors: Danilo P. Buan, Easton; Bettadapur S. Ananthamurthy, Norwalk, both of Conn.

[73] Assignee: Pitney Bowes Inc., Stamford, Conn.

[21] Appl. No.: 496,160

[22] Filed: May 19, 1983

[51] Int. Cl.[3] ..... B41F 27/00

[52] U.S. Cl. ..... 101/384; 101/371

[58] Field of Search ..... 101/45, 74, 76, 91, 101/92, 109, 110, 55, 56, 371-372, 382 R, 384, 395

[56] References Cited

U.S. PATENT DOCUMENTS

| | | | |
|---|---|---|---|
| 3,033,107 | 5/1962 | Hanley | 101/371 X |
| 3,156,179 | 11/1964 | Lundquist | 101/91 |
| 3,469,777 | 9/1969 | Anderson et al. | 101/91 X |
| 3,712,213 | 1/1973 | Flemino | 101/110 X |
| 3,782,276 | 1/1974 | Nakada et al. | 101/56 |
| 4,064,802 | 12/1977 | Funahashi | 101/110 X |
| 4,227,453 | 10/1980 | McInnis | 101/45 |
| 4,246,643 | 1/1981 | Hubbard | 101/91 X |

FOREIGN PATENT DOCUMENTS

| | | | |
|---|---|---|---|
| 8605 | of 1927 | Australia | 101/91 |

*Primary Examiner*—E. H. Eickholt

*Attorney, Agent, or Firm*—Peter Vrahotes; Albert W. Scribner; William D. Soltow, Jr.

[57] ABSTRACT

A postage meter indicia plate that has openings therein for the purpose of receiving the print wheels of the postage meter print head. The surface of the plate is covered with a elastomeric material so as to facilitate printing but has a metallic portion exposed in this elastomeric material for including identification markings. A locking mechanism is also provided so that the indicia plate cannot be removed from the postage meter without complete disassembly of the latter.

6 Claims, 4 Drawing Figures

INDICIA PLATE FOR A POSTAGE METER

BACKGROUND OF THE INVENTION

A postage meter is a well known device that places postage upon one corner of an envelope or upon a tape that is to be attached to a parcel. To facilitate this purpose, mechanisms are provided whereby the amount of postage may be selected and the date conveniently changed. Input to an electronic postage meter is accomplished through a keyboard and the input is exhibited upon a display board. The postage meter usually has two sets of print wheels, one of the sets being used for the purpose of printing the appropriate postage on the envelope or tape and the second set of print wheels is provided for placing the proper date adjacent to the printed postage. An indicia plate of some sort is usually provided to receive the print wheels of the postage meter. This indicia plate normally has raised portions thereon for the purpose of printing such items as the identity of the sender, meter number, provide a logo, pictorial graphics and the like. Normally, these indicia plates are made of metal with an elastomeric coating or overlay with raised portions for the purpose of printing.

An additional requirement to postage meters is that they be identified because of reasons of security. For this reason, every postage meter has an individual identification number and a record is kept of every meter that is placed in the hands of a customer or user. Although the identification number is normally stamped on the body or frame of the meter at the time of manufacture, there are times when it is advantageous to have the meter identification number added to the meter at a subsequent time. In this way, the meters may be assembled and shipped and after the meters have arrived at their destination, identification numbers may be secured thereto. A problem arises as to how to accomplish this in a convenient and secure manner after the meter has been assembled.

SUMMARY OF THE INVENTION

An indicia plate is provided for a postage meter that is made of metal but has an elastomeric surface thereon, this elastomeric surface being vulcanized to the metal plate. Openings are provided therein so that the print wheels of the postage meter may extend therethrough to allow printing of postage and the date. The elastomeric material has another opening therein to allow exposure of a metallic surface, this surface being machine ground. An identification number may be engraved in the exposed metal surface by selective means.

Although the indicia plate is provided with means for securing the same to the postage meter, additional mechanisms are provided to lock the plate to the postage meter in such a way that the postage meter must be disassembled at least partially in order to remove the indicia plate.

DETAILED DESCRIPTION OF THE PREFERRED EMBODIMENT

Figure 1:
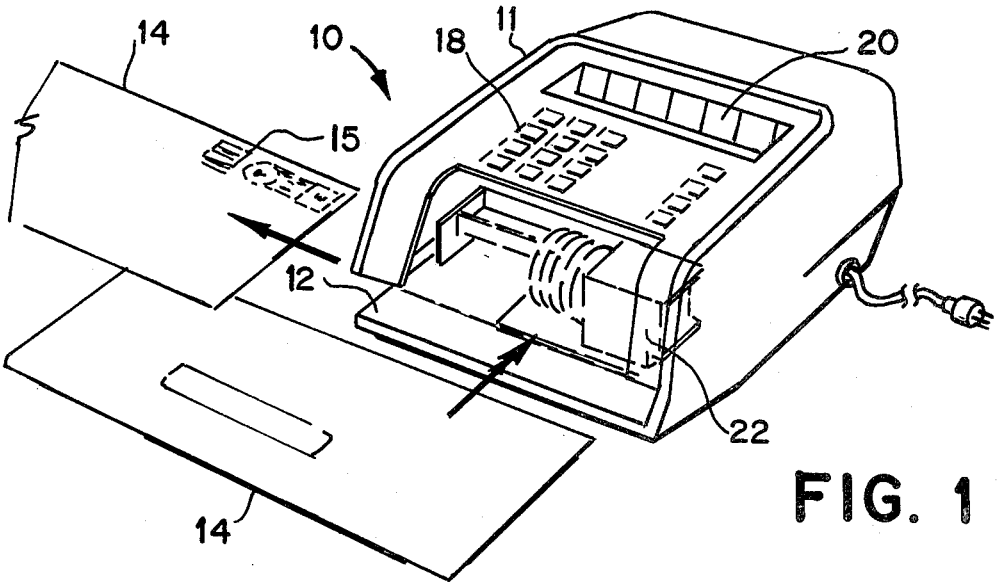
FIG. 1 shows a perspective view of an electronic postage meter of the reciprocating platen type wherein the instant invention may be incorporated.
Figure 2:
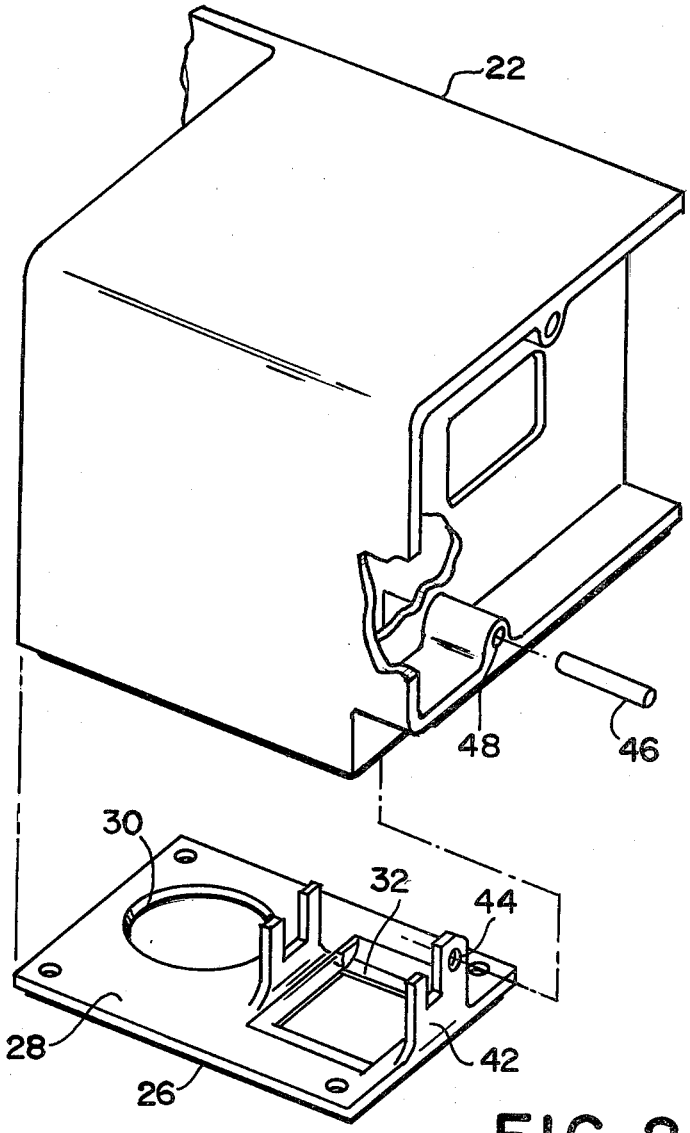
FIG. 2 shows a perspective, exploded view of a portion of the die bracket of the postage meter in FIG. 1 showing the indicia plate in detail.
Figure 3:
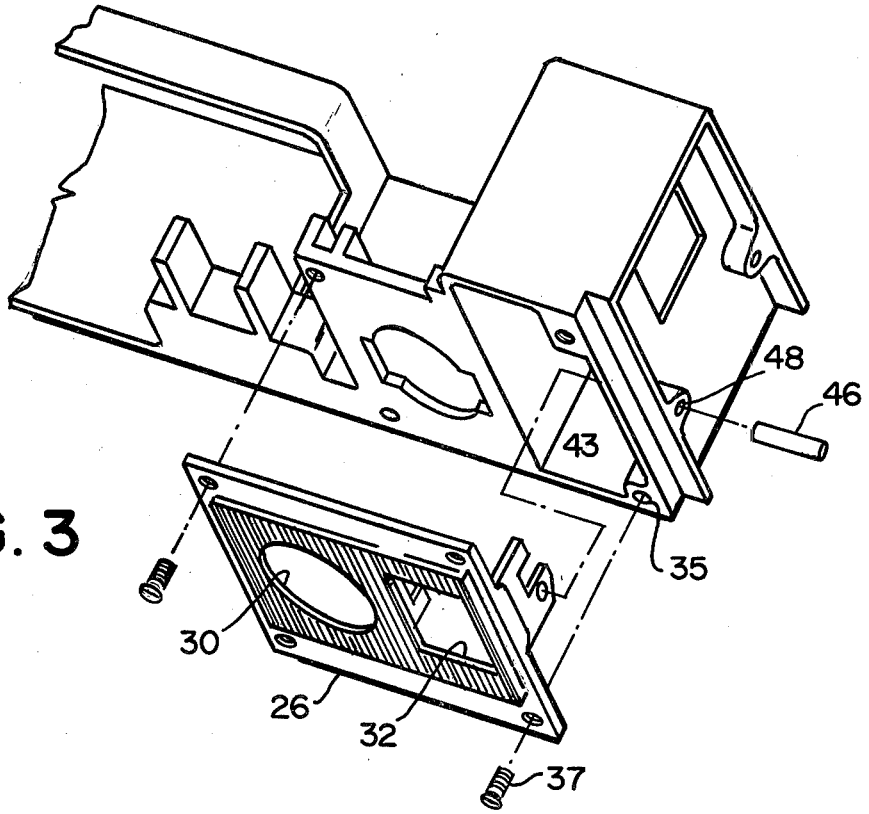
FIG. 3 is another perspective, exploded view of a portion of the die bracket of the meter with a detailed view of the indicia plate.
Figure 4:
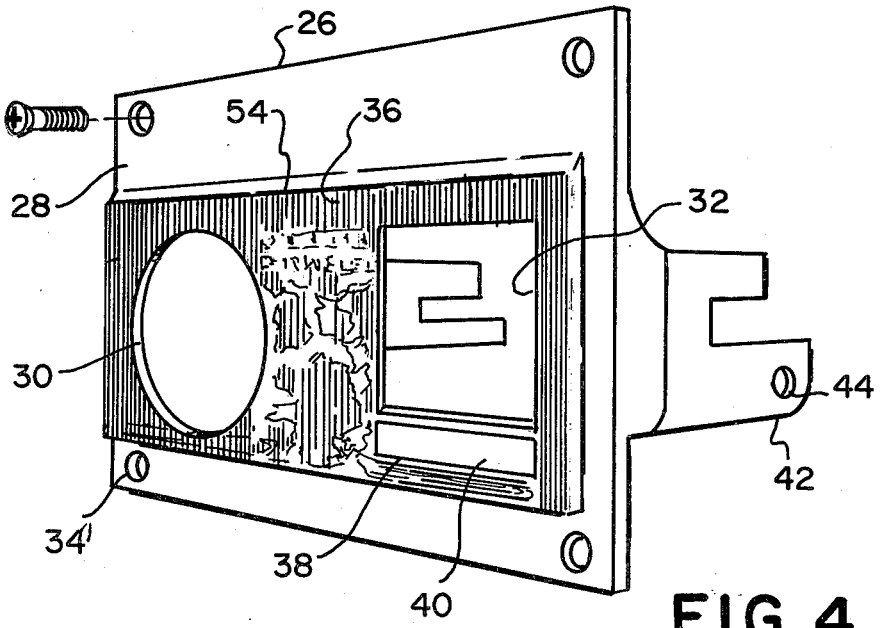
FIG. 4 is an enlarged view showing details of the indicia plate shown in FIGS. 2 and 3.

Referring now to FIG. 1, an electronic postage meter is shown generally at 10. This postage meter is of the reciprocating platen type but it will be appreciated that the principles of the instant invention may be incorporated in postage meters having rotary drums. The postage meter 10 has a cover 11 with a slot 12 therein wherein a mail piece such as an envelope 14 may be inserted for the purpose of printing postage and an indicia 15 on one corner of the envelope as is well known. The cover 11 normally has a lid, but this has been removed for purposes of illustration. Disposed within the postage meter 10 are two sets of print wheels which normally lie behind the cover. The first set of print wheels is provided to print the amount of postage on an envelope 14, i.e. value print wheels, and the second set of print wheels is provided to print the date on the envelope. These print wheels may be selectively positioned by means of a keyboard 18 and the position of the print wheels would be indicated upon a display panel 20. The print wheels are rotatably supported within a die extension bracket 22. Since the means for selectively rotating the print wheels is well known and does not form part of the instant invention. This part of the postage meter will not be described.

Located below the print wheels is a platen that is operative to be reciprocated upon actuation of the postage meter so as to urge an envelope 14 against the print wheels when postage is to be printed upon such envelope. An indicia plate 26 (not shown in FIG. 1) is secured to the die bracket 22 and has a metal body 28 with a date opening 30 and a postage opening 32. The plate has a plurality of openings 34 therein that are aligned with threaded openings 35 in the die extension bracket. The metal body 28 has an elastomeric overlay 36 secured thereto. This elastomeric overlay 36 may be made of a material such as butadiene acylonitride polyurethane, available under the trademark BUNAN which is a trademark of Uniroyal Inc. Preferably, the elastomeric coating is secured to the metal body 26 through a vulcanization process. The elastomeric cover may have raised portions 54 for the purpose of printing the indicia 15.

The elastomeric overlay 36 has an opening 38 therein so as to expose a flat portion 40 of the underlying metal body 28. Preferably, this exposed portion 40 will be made out of a rigid material with a machine smooth surface so that an engraving of identification numbers may be performed.

The indicia plate 26 has a pair of arms 42 which are received within the die extension bracket so as to abut the inside surface of a wall 43. One of the arms 42 has an opening 44 therein that is adapted to receive a pin 46. The pin 46 also is receivable within an opening 48 in the die extension bracket 22 so as to prevent the indicia plate 26 from being pulled out of the postage meter 10 without the postage meter being at least partially disassembled. As a minimum, the cover 11 would require removal before the pin 46 would be exposed. In this way, an identification number may be placed upon the machine surface 40 without concern of the same being removed by unauthorized personnel since the cover 11 of the postage meter is securely fastened.

What is claimed is:

1. An indicia plate for attachment to a postage meter, comprising:

a metallic plate having a first opening therein for receiving postage print wheels of the postage meter, a second opening for receiving the date wheels of the postage meter, an area located about the openings having an elastomeric material attached thereon and means for securing the metallic plate to the interior of the postage meter including a pair of arms integral with and extending from the metallic plate, at least one of said arms having an opening therein.

2. An indicia plate for attachment to a postage meter having a die bracket therein that rotatably supports a set of postage value print wheels and a set of date print wheels, comprising:

a metallic plate having a first opening therein for receiving the postage value print wheels, a second opening for receiving the data print wheels, the plate having a first surface with an elastomeric overlay attached thereon, said elastomeric overlay having an opening therein to expose a portion of the metal plate, and means for securing the metallic plate to the die bracket.

3. An indicia plate assembly for inclusion in a postage meter having a cover, a slot for receiving a mailpiece, a reciprocating platen movable within the slot, a bracket supported adjacent the slot opposite the platen, and print wheels supported by the bracket, comprising:

a metallic indicia plate having at least one opening therein for receiving the print wheels of the postage meter, and means for securing the metallic plate to the bracket so that the plate addresses the platen, at least a portion of said securing means being located within the interior of the postage meter at a location enclosed by the cover.

4. The indicia plate assembly of claim 3 wheren said surface addressing said platen has an overlay of elastomeric material.

5. An indicia plate assembly for inclusion in a postage meter having a cover, a slot for receiving a mailpiece, a reciprocating platen movable within the slot, a bracket supported adjacent the slot opposite the platen, and print wheels supported by the bracket, comprising:

a metallic plate having at least one opening therein for receiving the print wheels, said metallic plate having an elastomeric overlay secured thereto, said elastomeric overlay having an opening therein to expose a portion of said metallic plate, and means for securing the metallic plate to the bracket so that the plate addresses the platen, at least a portion of said securing means being located within the interior of the postage meter at a location enclosed by the cover.

6. An indicia plate assembly for inclusion in a postage meter having a cover, a slot for receiving a mailpiece, a reciprocating platen movable within the slot, a bracket supported adjacent the slot opposite the platen, and printing wheels supported by the bracket, comprising:

an indicia plate having at least one opening therein for receiving the printing wheels at least one arm of the postage meter, and means for securing the metallic plate to the bracket so that the plate addresses the platen, at least one arm extending from said indicia plate in a direction opposite to the plate, said arm having an opening being receivable within the bracket of the postage meter, and a pin receivable within said arm opening and said bracket for securing said indicia plate to said bracket.

* * * * *